United States Patent [19]

Suzuki

[11] Patent Number: 5,050,567

[45] Date of Patent: Sep. 24, 1991

[54] FUEL SUPPLY SYSTEM

[75] Inventor: Isamu Suzuki, Obu, Japan

[73] Assignee: Aisan Kogyo Kabushiki Kaisha, Obu, Japan

[21] Appl. No.: 649,714

[22] Filed: Feb. 1, 1991

[51] Int. Cl.[5] ..... F02M 37/10; F02M 37/18; F02M 37/20

[52] U.S. Cl. ..... 123/514; 123/509; 123/512; 123/497; 137/566; 137/576; 137/432

[58] Field of Search ..... 123/509, 514, 510, 512, 123/497; 137/566, 567, 576, 571, 587, 589, 393, 432, 433

[56] References Cited

U.S. PATENT DOCUMENTS

| | | | |
|---|---|---|---|
| 2,953,156 | 9/1960 | Bryant | 137/566 |
| 4,178,004 | 12/1979 | Shinoda et al. | 137/576 |
| 4,212,600 | 7/1980 | Otto et al. | 137/587 |
| 4,503,885 | 3/1985 | Hall | 137/599.1 |
| 4,651,701 | 3/1987 | Weaver | 123/509 |
| 4,672,937 | 6/1987 | Fales et al. | 123/509 |
| 4,724,860 | 2/1988 | Kelch | 137/433 |
| 4,776,315 | 10/1988 | Greiner | 123/510 |
| 4,780,063 | 10/1988 | Tuckey | 137/565 |
| 4,831,990 | 5/1989 | Tuckey | 123/510 |
| 4,838,307 | 6/1989 | Sasaki et al. | 137/571 |
| 4,844,704 | 7/1989 | Jiro | 123/509 |
| 4,869,225 | 9/1989 | Nagata et al. | 123/509 |
| 4,878,518 | 11/1989 | Tuckey | 137/566 |
| 4,893,647 | 1/1990 | Tuckey | 123/514 |
| 4,905,726 | 3/1990 | Kasugai et al. | 137/433 |
| 4,919,103 | 4/1990 | Ishiguro et al. | 123/509 |
| 4,928,657 | 5/1990 | Asselin | 123/497 |
| 4,971,017 | 11/1990 | Beakley et al. | 137/433 |
| 4,974,570 | 12/1990 | Szwargulski et al. | 123/509 |
| 4,989,572 | 2/1991 | Giacomazzi et al. | 137/576 |

FOREIGN PATENT DOCUMENTS

| | | |
|---|---|---|
| 56-107952 | 8/1981 | Japan . |
| 62-56759 | 4/1987 | Japan . |

*Primary Examiner*—Willis R. Wolfe
*Assistant Examiner*—T. N. Moulis
*Attorney, Agent, or Firm*—Dennison, Meserole, Pollack & Scheiner

[57] ABSTRACT

A fuel supply system comprising a main tank for storing a fuel; a subtank provided in the main tank for storing a part of the fuel; a first communication line for communicating the main tank to the subtank; a first pump provided in the first communication line for supplying the fuel from the main tank through the first communication line to the subtank; a first mechanism provided downstream of the first pump in the first communication line for limiting an amount of the fuel to be supplied from the first pump to the subtank and maintaining a level of the fuel to be stored in the subtank; a second communication line for communicating the subtank to an engine; a second pump provided in the second communication line for supplying the fuel from the subtank through the second communication line to the engine; a fuel return pipe for returning an uncomsumed part of the fuel from the engine to the subtank; and a second mechanism for regulating an amount of the fuel to be supplied from the second pump to the engine according to an amount of the fuel to be returned from the engine through the fuel return pipe to the subtank.

5 Claims, 4 Drawing Sheets

FUEL SUPPLY SYSTEM

BACKGROUND OF THE INVENTION

The present invention relates to a fuel supply system for supplying a fuel from a fuel tank to an engine.

It is known that a fuel tank mounted on a vehicle is separately constructed of a main tank and a subtank provided in the main tank, so as to reliably supply a small amount of fuel in the fuel tank to the engine even when the fuel is deflected in the fuel tank upon inclination or acceleration of the vehicle. In the fuel tank of this type, the fuel in the main tank is once supplied to the subtank, and a predetermined amount of the fuel is stored in the subtank. The fuel in the subtank is supplied to the engine. Accordingly, even when the fuel in the main tank is deflected, the fuel in the subtank can be reliably supplied to the engine without idling of a pump.

Further, it is also known that an unconsumed part of the fuel supplied to the engine is returned to the subtank. In such a fuel supply system, when a constant amount of fuel is supplied from the subtank to the engine in spite of a large amount of return fuel from the engine to the subtank, the fuel is unnecessarily circulated between the subtank and the engine to cause not only a loss of energy but also an increase in temperature of the fuel in the subtank due to a hot return fuel from the engine. Such an increase in temperature of the fuel causes the generation of fuel vapor in the subtank, and the fuel vapor tends to induce vapor lock in the pump or the engine.

Further, when the level of the fuel in the subtank exceeds a predetermined level, the fuel overflows into the main tank. Accordingly, the fuel in the main tank is warmed by such an overflowing fuel from the subtank including a hot return fuel from the engine, thus causing the generation of fuel vapor in the main tank.

The above-mentioned fuel supply system of the type where an unconsumed part of the fuel supplied to the engine is returned to the subtank is known from Japanese Patent Laid-open Publication No. 56-107952 and Japanese Utility Model Laid-open Publication No. 62-56759, for example. In these references, it is proposed that an amount of return fuel from the engine to the fuel tank is detected, and a driving power for the pump is reduced with an increase in the amount of the return fuel to thereby make the return fuel amount constant.

This prior art technique can be applied to the subtank so as to suppress undue circulation between the subtank and the engine. However, the adaptation of this technique to the suppression of undue circulation between the subtank and the main tank is not considered in the above references. Accordingly, it is not possible to prevent that a part of the return fuel in the subtank is circulated from the subtank to the main tank to cause a temperature increase in the fuel in the main tank and accordingly generate the fuel vapor in the main tank.

SUMMARY OF THE INVENTION

It is an object of the present invention to provide a fuel supply system which can suppress circulation from the subtank to the main tank, so as to avoid the generation of fuel vapor in the main tank due to a hot return fuel from the engine to the subtank.

It is another object of the present invention to provide a fuel supply system which can suppress undue circulation from the engine to the subtank with a simple and inexpensive construction, so as to avoid the generation of fuel vapor in the subtank due to a hot return fuel from the engine to the subtank.

According to the present invention, there is provided a fuel supply system comprising a main tank for storing a fuel; a subtank provided in said main tank for storing a part of said fuel; a first communication line for communicating said main tank to said subtank; a first pump provided in said first communication line for supplying said fuel from said main tank through said first communication line to said subtank; first means provided downstream of said first pump in said first communication line for limiting an amount of said fuel to be supplied from said first pump to said subtank and maintaining a level of said fuel to be stored in said subtank; a second communication line for communicating said subtank to an engine; a second pump provided in said second communication line for supplying said fuel from said subtank through said second communication line to said engine; a fuel return pipe for returning an unconsumed part of said fuel from said engine to said subtank; and second means for regulating an amount of said fuel to be supplied from said second pump to said engine according to an amount of said fuel to be returned from said engine through said fuel return pipe to said subtank.

In a first aspect of the present invention, said first means comprises a first orifice provided in said first communication line so as to be opened and closed for varying a flow passage area of said first communication line, and a float adapted to float on a surface of said fuel in said subtank and mechanically connected with said first orifice, said float being displaced in a closing direction of said first orifice in concern with lifting of the level of said fuel in said subtank, while being displaced in an opening direction of said first orifice in concert with lowering of the level of said fuel in said subtank.

In a second aspect of the present invention, said first means comprises a return line branched from said first communication line on a downstream side of said first pump for returning said fuel discharged from said first pump to said main tank, a first orifice provided in said return line so as to be opened and closed for varying a flow passage area of said return line, and a float adapted to float on a surface of said fuel in said subtank and mechanically connected with said first orifice, said float being displaced in an opening direction of said first orifice in concert with lifting of the level of said fuel in said subtank, while being displaced in a closing direction of said first orifice in concert with lowering of the level of said fuel in said subtank.

In a third aspect of the present invention, said second means comprises a second orifice provided in said second communication line so as to be opened and closed for varying a flow passage area of said second communication line, and a pressure receiving member provided near an outlet of said fuel return pipe in said subtank and mechanically connected with said second orifice for receiving a pressure of said fuel returned from said engine to said subtank, said pressure receiving member being displaced in a closing direction of said second orifice in concert with an increase in said fuel to be returned from said engine through said fuel return pipe to said subtank, while being displaced in an opening direction of said second orifice in concert with a decrease in said fuel to be returned from said engine through said fuel return pipe to said subtank.

In a fourth aspect of the present invention, said second means comprises a return line branched from said second communication line at a position downstream of a suction port of said second pump for returning said fuel sucked from said suction port to said subtank, a second orifice provided in said return line so as to be opened and closed for varying a flow passage area of said return line, and a pressure receiving member provided near an outlet of said fuel return pipe in said subtank and mechanically connected with said second orifice for receiving a pressure of said fuel returned from said engine to said subtank, said pressure receiving member being displaced in an opening direction of said second orifice in concert with an increase in said fuel to be returned from said engine through said fuel return pipe to said subtank, while being displaced in a closing direction of said second orifice in concert with a decrease in said fuel to be returned from said engine through said fuel return pipe to said subtank. Alternatively, the return line of the second means may be branched from said second communication line at a position downstream of a discharge port of said second pump and returned to a position downstream of a suction port of said second pump and upstream of said discharge port for returning said fuel discharged from said discharge port to said second pump.

The invention will be more fully understood from the following detailed description and appended claims when taken with the drawings.

DETAILED DESCRIPTION OF THE PREFERRED EMBODIMENTS

Figure 1:
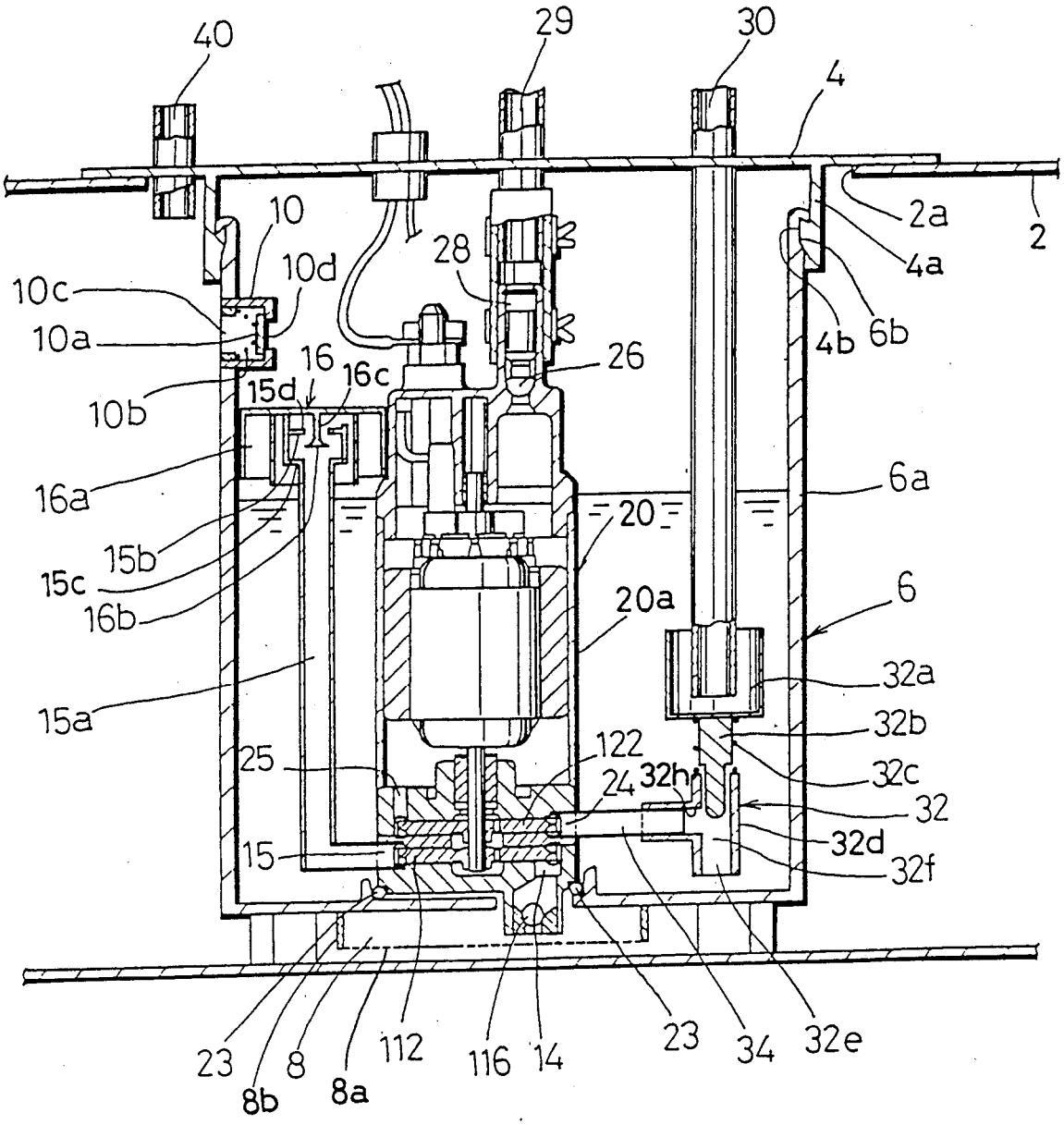
FIG. 1 is a vertical sectional view of a first preferred embodiment of the present invention.

Referring now to FIG. 1 showing a first preferred embodiment of the present invention, reference numeral 2 designates a main tank for storing a fuel, and reference numeral 6 designates a subtank provided in the main tank 2 at a substantially central portion thereof.

The subtank 6 is comprised of a cylindrical container 6*a* and a flanged iron plate 4 for fixing the cylindrical container 6*a* to the main tank 2.

The container 6*a* is formed of resin such as polyamide or polyacetal. The container 6*a* is formed at its upper end portion with a circular recess 6*b*. The flanged iron plate 4 is formed with a cylindrical downward projection 4*a*. The cylindrical downward projection 4*a* is formed at its inner circumference with a circular inward projection 4*b* adapted to engage the circular recess 6*b* of the container 6*a*. The container 6*a* is tightly sealably mounted to the flanged iron plate 4 by inserting the upper end portion of the container 6*a* into the inside of the cylindrical downward projection 4*a* of the flanged iron plate 4 and thereby tightly engaging the circular recess 6*b* of the container 6*a* with the circular inward projection 4*b* of the cylindrical downward projection 4*a* of the flanged iron plate 4.

The subtank 6 is inserted from an upper opening 2*a* of the main tank 2 thereinto, and the flanged iron plate 4 having a diameter larger than that of the upper opening 2*a* is retained so as to contact an outside surface of the main tank 2. The flanged iron plate 4 is firmly fixed to the main tank 2 by means of bolts and nuts (not shown).

The container 6*a* of the subtank 6 is formed at its bottom with a cylindrical downward projection 8*b*. A flat filter 8*a* is mounted to a bottom end of the cylindrical downward projection 8*b*. Thus, there is defined a filter chamber 8 by the bottom of the container 6*a*, the projection 8*b* and the filter 8*a*.

A motor-driven fuel pump 20 is provided in the central portion of the subtank 6. The fuel pump 20 is a two-stage regenerative pump consisting of a first pump section 112 forming a first stage and a second pump section 122 forming a second stage.

A first fuel suction hole 14 of the fuel pump 20 is formed to pass through the bottom of the subtank 6 and communicate with the filter chamber 8. A check valve 116 is provided in the first suction hole 14, so as to prevent reverse flow of the fuel from the fuel pump 20 to the filter chamber 8. An O-ring seal 23 is interposed between the fuel pump 20 and the bottom of the subtank 6, so as to prevent leakage of the fuel from the inside of the subtank 6 to the filter chamber 8.

The fuel in the filter chamber 8 is sucked from the first suction hole 14 of the fuel pump 20, and is then boosted in the first pump section 112, thereafter being discharged from a first discharge hole 15. The fuel discharged above is fed through a fuel discharge pipe 15*a* connected to the first discharge hole 15, and is then fed through a float valve 16 mounted to an upper end of the fuel discharge pipe 15*a*, thereafter being discharged into the inside of the subtank 6.

Thus, a fuel passage leading from the filter chamber 8 through the first pump section 112, the fuel discharge pipe 15*a* and the float valve 16 to the subtank 6 is formed to serve as a first communication line for communicating the main tank 2 with the subtank 6 according to the present invention.

The fuel discharge pipe 15*a* is formed to have an L-shaped vertical cross section. One end of the fuel discharge pipe 15*a* is connected to the first discharge hole 15 of first pump section 112, and the other end is open through the float valve 16 into the subtank 6 at a vertical position corresponding to a predetermined fuel level in the subtank 6.

The float valve 16 is comprised of a float portion 16*a* maintained under a floating condition and a cylindrical fixed portion 15*c* integrally formed with the upper end portion of the fuel discharge pipe 15*a*. The float portion 16*a* is formed with a substantially conical valve body 16*b* and a rod portion 16*c* connecting a top end of the conical valve body 16*b* to a lower inside surface of the float portion 16*a*. The fixed portion 15*c* is formed with a valve seat 15*b* having a central circular hole 15*d*. The rod portion 16*c* connecting the valve body 16*b* to the lower inside surface of the float portion 16*a* is positioned in the circular hole 15*d* of the valve seat 15*b* to define an annular flow passage. The valve body 16*b* is operated to contact the valve seat 15*b* from the under side thereof.

When the fuel level in the subtank 6 is lower than the level of the float valve 16, the float portion 16*a* is maintained at a lower limit position without receiving the buoyancy of the fuel. Accordingly, the valve body 16*b* connected to the float portion 16*a* is also maintained at a lower limit position, so that a distance between the valve body 16*b* and the valve seat 15*b* is maximum, and a flow passage area in the float valve 16 is therefore maximum.

In contrast, when the fuel level in the subtank 6 reaches the level of the float valve 16, the float portion 16*a* receives the buoyancy of the fuel to upwardly move in concert with the lift of the fuel level. Accordingly, the valve body 16*b* connected to the float portion 16*a* is upwardly displaced to approach the valve seat 15*b*, so that the flow passage area in the float valve 16 is reduced. When the valve body 16*b* is further raised in concert with the further lift of the fuel level, the valve body 16*b* is brought into complete contact with the valve seat 15*b* to close the flow passage of the float valve 16.

Thus, the valve body 16*b* serves as a first variable orifice for varying a flow passage area of the first communication line.

The fuel fed through the first communication line into the subtank 6 is sucked from a fuel inlet 32*e* of a flow regulating valve 32 through a passage 34 and a second suction hole 24 of the second pump section 122 thereinto. After boosted in the second pump section 122, the fuel is discharged from a second discharge hole 25 to the inside of a motor housing 20*a* of the fuel pump 20. Then, the fuel is fed through the inside of the motor housing 20*a* as cooling the same, and is discharged through a check valve 26 and a fuel discharge portion 28 of the fuel pump 20 to a fuel supply pipe 29, thereafter being supplied through the fuel supply pipe 29 to an engine (not shown).

This, a fuel passage leading from the fuel inlet 32*e* of the flow regulating valve 32 through the passage 34, the second pump section 122, the motor housing 20*a* and the fuel supply pipe 29 to the engine is formed to serve as a second communication line for communicating the subtank 6 with the engine.

A discharge capacity of the first pump section 112 is set to be greater than that of the second pump section 122, and the discharge capacity of the second pump section 122 is set to be greater than a maximum fuel consumption by the engine. Therefore, an unconsumed amount of the fuel fed from the second pump section 122 to the engine is returned through a fuel return pip 30 to the subtank 6.

The fuel returned through the fuel return pipe 30 to the subtank 6 is received by a fuel receptacle 32*a* of the flow regulating valve 32 and downwardly urges the fuel receptacle 32*a* to overflow into the subtank 6.

The fuel receptacle 32*a* of the flow regulating valve 32 is formed at its bottom with a substantially columnar downward projection 32*b* serving as a valve body. A lower half portion of the valve body 32*b* is slidably inserted in a cylindrical valve case 32*d* from an upper opening thereof. The valve case 32*d* is formed with a side opening 32*h* communicated with the passage 34. A lower opening of the valve case 32*d* is formed as the fuel inlet 32*e* opening to the inside of the subtank 6. Thus, a fuel passage from the fuel inlet 32*e* to the side opening 32*h* is formed as a flow passage 32*f* in the flow regulating valve 32. When the valve body 32*b* connected to the fuel receptacle 32*a* is downwardly displaced by the pressure of the return fuel, a flow passage area of the flow passage 32*f* is reduced. A coil spring 32*c* is interposed between a bottom outer surface of the fuel receptacle 32*a* and an upper end of the valve case 32*d* to normally upwardly bias the fuel receptacle 32*a* and thereby normally upwardly displace the valve body 32*b*. Accordingly, when a fuel amount returned from the engine through the fuel return pipe 30 to the subtank 6 is minimum, the fuel receptacle 32*a* and the valve body 32*b* are maintained at an upper limit position, and the flow passage area of the flow passage 32*f* in the flow regulating valve 32 therefore becomes maximum. Conversely, when a large amount of fuel is returned from the engine through the fuel return pipe 30 to the subtank 6, the fuel receptacle 32*a* is downwardly urged by the pressure of the large amount of such a return fuel. Accordingly, the fuel receptacle 32*a* and the valve body 32*b* are downwardly displaced against the biasing force of the coil spring 32*c*, and the flow passage area of the flow passage 32*f* in the flow regulating valve 32 is reduced.

Thus, the valve body 32*b* of the flow regulating valve 32 serves as a second variable orifice for varying a flow passage area of the second communication line according to the present invention. Further, the fuel receptacle 32*a* of the flow regulating valve 32 serves as a pressure receiving member for regulating a flow passage area of the second variable orifice according to a fuel amount returned from the engine to the subtank 6 according to the present invention.

A pressure retention valve 10 is provided on the side wall of the subtank 6 at a level higher than that of the float valve 16. The pressure retention valve 10 is provided with a passage 10*c* for communicating the subtank 6 with the main tank 2. The passage 10*c* is formed with a restricted portion 10*d*. A valve member 10*a* is provided in the passage 10*c* to normally close the restricted portion 10*d*. A spring 10*b* is also provided in the passage 10*c* to normally bias the valve member 10*a* in a closing direction thereof.

Accordingly, the pressure in the subtank 6 is maintained at a predetermined value depending upon a biasing force of the spring 10*b*. That is, so far as the pressure of fuel vapor generated in the subtank 6 is not greater than the predetermined value, the fuel vapor is prevented from being discharged from the subtank 6 through the valve retention valve 10 into the main tank 2.

Further, a vapor discharge pipe 40 is provided through the flanged iron plate 4, so as to discharge a fuel vapor generated in the main tank 2 to a vapor processing device (not shown).

The operation of the first preferred embodiment will now be described.

When the motor-driven fuel pump 20 is driven under the condition where no fuel is present in the subtank 6, the fuel in the main tank 2 is sucked by the fuel pump 20 to pass through the filter 8*a* into the filter chamber 8 and then flow from the first suction hole 14 into the first pump section 112. After boosted in the first pump section 112, the fuel is discharged from the first discharge hole 15 into the fuel discharge pipe 15*a*, and is then fed through the float valve 16 to the subtank 6. At this time, since no buoyancy is applied to the float portion 16*a* of the float valve 16, the valve body 16*b* is remote from the valve seat 15*b* at the maximum to maintain a maximum flow passage area in the float valve 16. Accordingly, a maximum discharge capacity of the first pump section 112 is exhibited to efficiently supply the fuel in the main tank 2 to the subtank 6.

Then, the fuel supplied into the subtank 6 is sucked from the fuel inlet 32*e* of the flow regulating valve 32 by the second pump section 122, and after boosted in the second pump section 122, the fuel is discharged from the second discharge hole 25 to the engine. As mentioned previously, since the discharge capacity of the first pump section 112 is set to be greater than that of the second pump section 122, an amount of the fuel in the subtank 6 is gradually increased during the operation to lift a fuel level in the subtank 6. Further, since the discharge capacity of the second pump section 122 is set to be greater than the maximum fuel consumption by the engine, an unconsumed part of the fuel supplied to the engine is returned through the fuel return pipe 30 to the subtank 6.

When an operational condition of the engine is so changed as to decrease the fuel consumption in the engine, a fuel amount to be returned from the engine to the subtank 6 is increased. As a result, the pressure of the return fuel downwardly urging the fuel receptacle 32*a* of the flow regulating valve 32 is increased, so that the valve body 32*b* of the flow regulating valve 32 is downwardly displaced to reduce the flow passage area of the flow passage 32*f* and accordingly reduce the fuel amount to be sucked from the fuel inlet 32*e* to the second pump section 122. As a result, the fuel amount to be supplied from the second pump section 122 to the engine is reduced so as to follow the reduced fuel consumption in the engine.

Conversely, when the fuel consumption in the engine is increased, the fuel amount to be returned from the engine to the subtank 6 is reduced. As a result, the pressure of the return fuel downwardly urging the fuel receptacle 32*a* of the flow regulating valve 32 is reduced, so that the valve body 32*b* of the flow regulating valve 32 is upwardly displaced to increase the flow passage area of the flow passage 32*f* and accordingly increase the fuel amount to be sucked from the fuel inlet 32*e* to the second pump section 122. As a result, the fuel amount to be supplied from the second pump section 122 to the engine is increased so as to follow the increased fuel consumption in the engine.

In this manner, the fuel amount to be stored into the subtank 6 is gradually increased during the operation. When the fuel level in the subtank 6 reaches the level of the float valve 16, the float portion 16*a* of the float valve 16 receives a buoyancy from the fuel to upwardly move in concert with the lift of the fuel level. Accordingly, the valve body 16*b* connected with the float portion 16*a* is also upwardly displaced to approach the valve seat 15*b* and accordingly reduce the flow passage area in the float valve 16. As a result, the fuel amount to be supplied from the first pump section 112 through the fuel discharge pipe 15*a* to the subtank 6 is reduced to thereby suppress the lift of the fuel level in the subtank 6.

Subsequently when the fuel level in the subtank 6 is lowered, the float portion 16*a* is also lowered in concert with the lowering of the fuel level. Accordingly, the valve body 16*b* is downwardly displaced away from the valve seat 15*b* and accordingly increase the flow passage area in the float valve 16. As a result, the fuel amount to be supplied from the first pump section 112 through the fuel discharge pipe 15*a* to the subtank 6 is increased to thereby suppress the lowering of the fuel level in the subtank 6.

Thus, the fuel level in the subtank 6 is controlled by the float valve 16 to maintain the predetermined level, that is, the level of the float valve 16. Accordingly, there is no possibility that the fuel in the subtank 6 as warmed by the hot return fuel from the engine will overflow through the pressure retention valve 10 since it is located above the float valve 16. Resultantly, it is possible to suppress heating of the fuel in the main tank 2 due to the hot return fuel from the engine and thereby suppress the generation of fuel vapor in the main tank 2.

Furthermore, as the fuel amount to be supplied to the engine is controlled by the flow regulating valve 32 according to a fuel consumption in the engine, undue fuel circulation between the fuel pump 20 and the engine can be suppressed to avoid energy loss. As a result, the amount of excess hot return fuel from the engine to the subtank 6 can be reduced to thereby suppress an increase in temperature of the fuel in the subtank 6 and suppress the generation of fuel vapor in the subtank 6.

Figure 2:
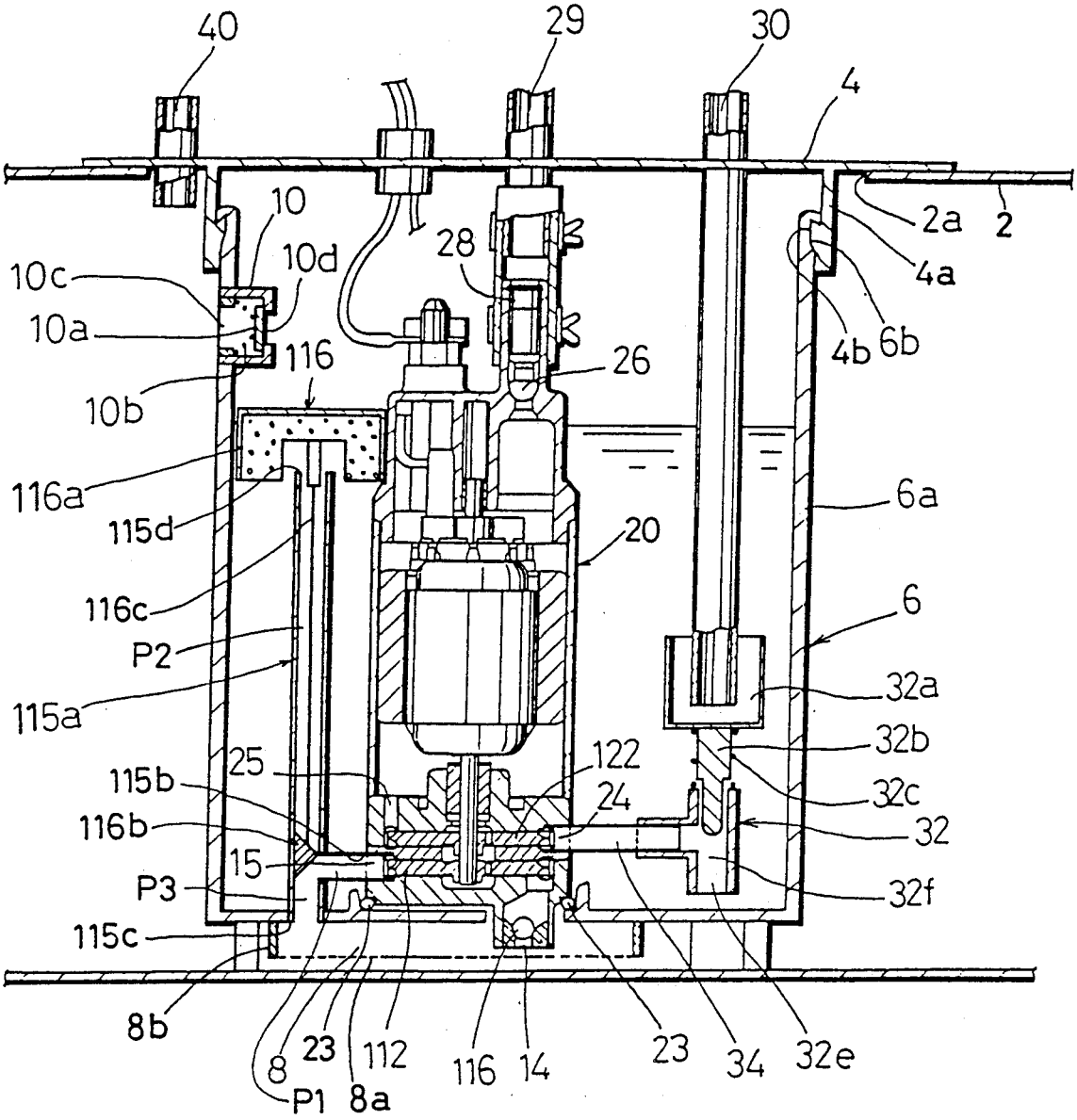
FIG. 2 is a vertical sectional view of a second preferred embodiment of the present invention.

Referring next to FIG. 2 showing a second preferred embodiment of the present invention, the structure of the float valve 16 and the structure of the fuel discharge pipe 15*a* used in the first preferred embodiment are modified. The other construction is substantially the same as that in the first preferred embodiment, and the explanation thereof will be omitted hereinafter.

In the second preferred embodiment, a fuel discharge pipe 115*a* is formed to have a laid T-shaped vertical cross section consisting of a horizontal passage P1 having a side opening 115*b* connected with the first discharge hole 15 of the first pump section 112, an upper vertical passage P2 having an upper opening 115*d* located at the predetermined level in the subtank 6, and a lower vertical passage P3 having a lower opening 115*c* located in the filter chamber 8.

A float valve 116 includes a float portion 116*a* located at the upper opening 115*d* of the passage P2 so as to vertically movably engage therewith. The float portion 116*a* is connected through a connecting rod 116*c* to a valve member 116*b*. The valve member 116*b* is vertically movably located in a junction area among the passages P1, P2 and P3. At an upper limit position of the valve member 116*b*, the passage P1 is communicated with the passage P3, and the passage P2 is closed by the valve member 116*b*. In contrast, at a lower limit position of the valve member 116*b*, the passage P1 is communicated with the passage P2, and the passage P3 is closed by the valve member 116*b*. At any other positions between the upper and lower limit positions of the valve member 116*b*, the passage P1 is communicated with both the passages P2 and P3, and variable flow passage areas of the passages P2 and P3 are obtained according to the vertical position of the valve member 116*b*. That is, when the valve member 116*b* is located near the upper limit position, the flow passage area of the passage P2 is smaller than that of the passage P3. In contrast, when the valve member 116*b* is located near the lower limit position, the flow passage area of the passage P2 is larger than that of the passage P3.

With this construction, when the fuel level in the subtank 6 is lower that the predetermined level, no buoyancy is applied from the fuel to the float portion 116*a* of the float valve 116, and accordingly the float portion 116*a* is maintained at its lower limit position where it is engaged with the upper opening 115*d* of the passage P2. Accordingly, the valve member 116*b* connected through the connecting rod 116*c* to the float portion 116*a* is located at its lower limit position to communicate the passage P1 with the passage P2 and close the passage P3. As a result, a total amount of the fuel discharged from the first discharge hole 15 of the first pump section 112 is supplied through the passages P1 and P2 to the subtank 6, and no fuel is returned to the filter chamber 8.

When the fuel level in the subtank 6 reaches the predetermined level, the float portion 116*a* of the float valve 116 receives a buoyancy of the fuel to upwardly move in concert with the lift of the fuel level. Accordingly, the valve member 116*b* is upwardly displaced to gradually increase the flow passage area of the passage P3. That is, an amount of the discharge fuel to be returned through the passages P1 and P3 to the filter chamber 8 is gradually increased, and as a result, the remaining amount of the discharge fuel to be supplied through the passage P2 to the subtank 6 is gradually reduced. Thus, the lift of the fuel level in the subtank 6 is suppressed.

In this manner, the fuel level in the subtank 6 is controlled by the float valve 116 to maintain the predetermined level. Accordingly, the same advantage as in the first preferred embodiment can be achieved.

Figure 3:
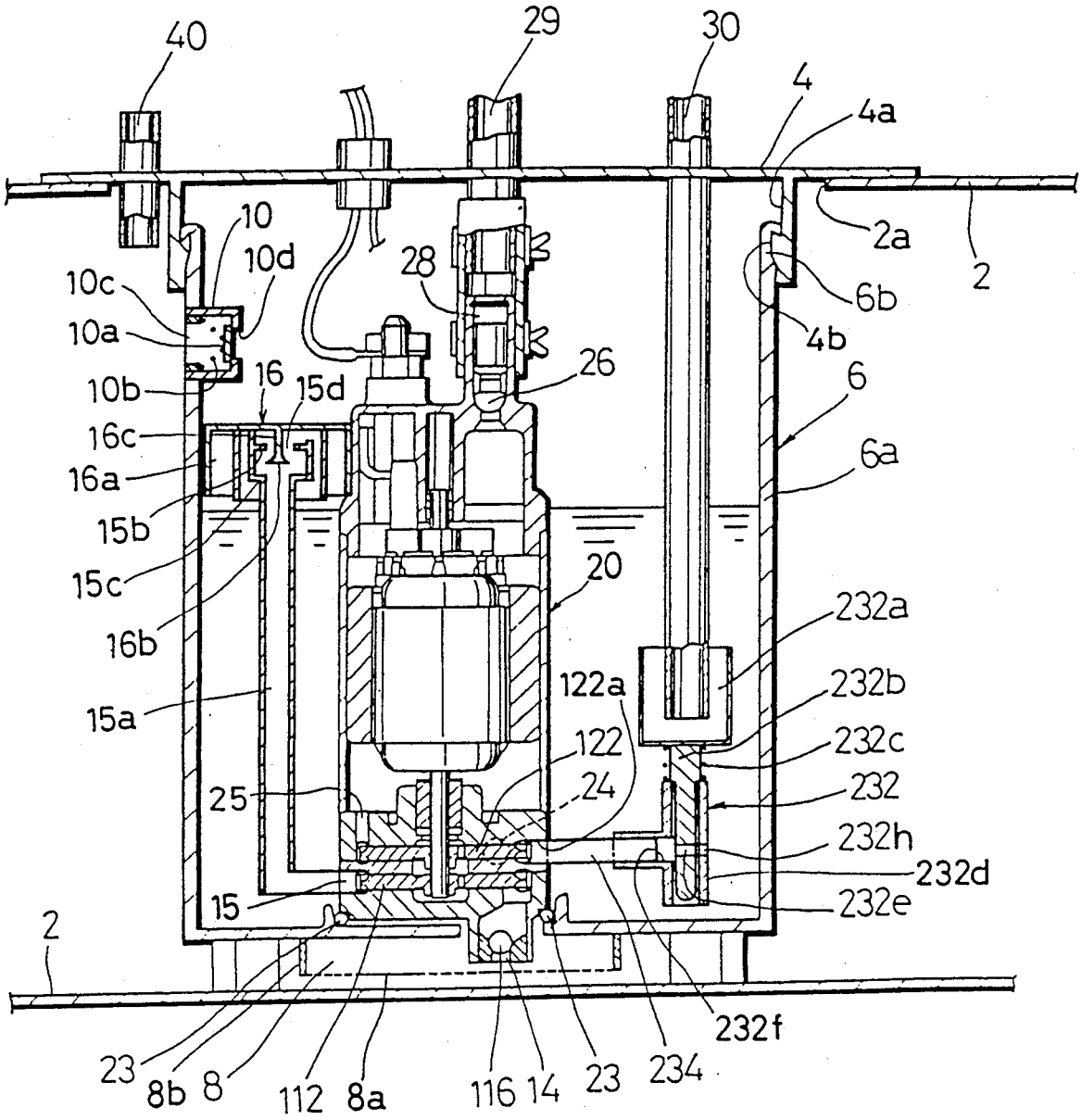
FIG. 3 is a vertical sectional view of a third preferred embodiment of the present invention.

Referring next to FIG. 3 showing a third preferred embodiment of the present invention, the structure of the boost line of the second pump section 122 and the structure of the flow regulating valve 32 used in the first preferred embodiment are modified. Particularly, the flow regulating valve 32 as modified is used as a relief valve for the second pump section 122 in the third preferred embodiment. The other construction is substantially the same as that in the first preferred embodiment, and the explanation thereof will be omitted hereinafter.

The fuel in the subtank 6 is sucked from the second suction hole 24 (shown by a dashed circle) of the second pump section 122. After boosted in the second pump section 122, the fuel is discharged from the second discharge hole 25 through the inside of the motor housing 20*a* to the engine. The boost line in the second pump section 122 is formed at its midway with a return port 122*a*. The return port 122*a* is connected to one end of a return passage 234. The other end of the return passage 234 is connected to a flow regulating valve 232.

The flow regulating valve 232 includes a fuel receptacle 232*a* and a substantially columnar valve body 232*b* downwardly projecting from an outside bottom surface of the fuel receptacle 232*a*. The valve body 232*b* is constructed of a large-diameter upper portion and a small-diameter lower portion. The small-diameter lower portion is slidably inserted in a cylindrical valve case 232*d*. The small-diameter lower portion is formed at its substantially central position with a through-hole 232*e* extending in a direction perpendicular to an axis of the valve body 232*b*. A side wall of the valve case 232*d* is also formed with a through-hole 232*h* having the same diameter as that of the through-hole 232*e*. On the diametrically opposite side of the through-hole 232*h*, the side wall of the valve case 232*d* is formed with an opening 232*f* connected with the end of the return passage 234. Further, a coil spring 232*c* is interposed between the outer bottom surface of the fuel receptacle 232*a* and the upper end of the valve case 232*d* to normally upwardly bias the fuel receptacle 232*a* and thereby normally upwardly displace the valve body 232*b*.

In operation, when the amount of return fuel from the engine to the subtank 6 is maximum, that is, when the pressure of the return fuel downwardly urging the fuel receptacle 232*a* is maximum, the fuel receptacle 232*a* is downwardly displaced at the maximum against the biasing force of the coil spring 232*c*, and the valve body 232*b* is accordingly located at its lower limit position. At this lower limit position, the through-hole 232*e* of the valve body 232*b* is aligned to the through-hole 232*h* of the valve case 232*d*. That is, a flow passage area of the return line leading from the boost line of the second pump section 122 through the return passage 234, the through-hole 232*e* and the through-hole 232*h* to the subtank 6 becomes maximum. As a result, the amount of the fuel to be returned from the boost line of the second pump section 122 to the subtank 6 becomes maximum, and therefore the amount of the fuel to be discharged from the second discharge hole 25 of the second pump section 122 to the engine becomes minimum.

Resulting from such a reduction in the fuel amount to be supplied to the engine, the amount of the return fuel from the engine to the subtank 6 is reduced. Accordingly, the pressure of the return fuel downwardly urging the fuel receptacle 232*a* is reduced, and the fuel receptacle 232*a* is therefore upwardly displaced by the biasing force of the coil spring 232*c*. That is, the valve body 232*b* connected with the fuel receptacle 232*a* is also upwardly displaced to thereby generate vertical slippage of the through-hole 232*e* relative to the through-hole 232*h*. As a result, the flow passage area of the return line is reduced, and therefore the fuel amount to be returned from the boost line in the second pump section 122 to the subtank 6 is reduced. That is, the fuel amount to be discharged from the second discharge hole 25 of the second pump section 122 to the engine is increased.

In this manner, the fuel amount to be supplied to the engine is controlled by the flow regulating valve 232 according to a fuel consumption in the engine. Accordingly, the same advantage as in the first preferred embodiment can be achieved.

Figure 4:
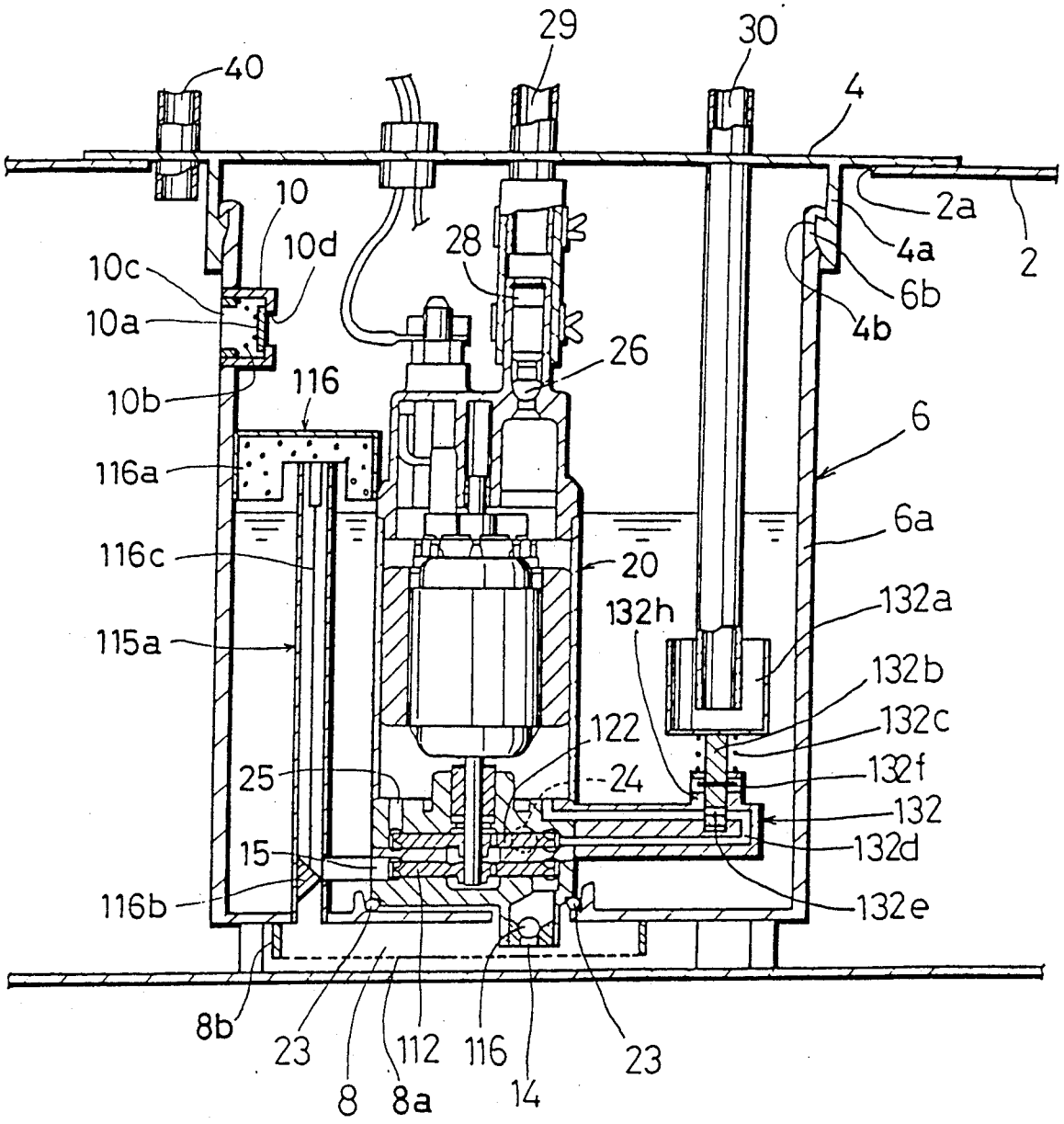
FIG. 4 is a vertical sectional view of a fourth preferred embodiment of the present invention.

Referring next to FIG. 4 showing a fourth preferred embodiment of the present invention, the structure of the boost line of the second pump section 122 and the structure of the flow regulating valve 32 used in the second preferred embodiment are modified so as to return the fuel discharged from the second discharge hole 25 to the boost line in the second pump section 122. The other construction is substantially the same as that in the second preferred embodiment, and the explanation thereof will be omitted hereinafter.

As similar to the third preferred embodiment, the fuel in the subtank 6 is sucked from the second suction hole 24 (shown by a dashed circle) of the second pump section 122, and after boosted in the second pump section 122, the fuel is discharged from the second discharge hole 25 through the inside of the motor housing 20*a* to the engine.

A return passage 132*d* is formed to communicate the inside of the motor housing 20*a* with the boost line of the second pump section 122 at a midway position thereof. Further, a flow regulating valve 132 is provided in the midway of the return passage 132*d*.

The flow regulating valve 132 includes a fuel receptacle 132*a* and a substantially columnar valve body 132*b* downwardly projecting from an outer bottom surface of the fuel receptacle 132*a*. The valve body 132*b* is formed at its lower portion with a through-hole 132*e* extending in a direction perpendicular to an axis of the valve body 132*b* and having a diameter substantially equal to that of the return passage 132*d*. The lower portion of the valve body 132*b* is vertically slidably inserted in a valve case 132*h*. A coil spring 132*c* is interposed between the outer bottom surface of the fuel receptacle 132*a* and the upper end of the valve case 132*h* to normally upwardly bias the fuel receptacle 132*a* and thereby normally upwardly displace the valve body 132*b*. Further, a restriction pin 132*f* is provided to restrict excess displacement of the valve body 132*b* out of a displaceable range.

In operation, when the amount of return fuel from the engine to the subtank 6 is maximum, that is, when the pressure of the return fuel downwardly urging the fuel receptacle 132*a* is maximum, the fuel receptacle 132*a* is downwardly displaced at the maximum against the biasing force of the coil spring 132*c*, and the valve body 132*b* is accordingly located at its lower limit position. At this lower limit position, the through-hole 132*e* of the valve body 132*b* is aligned to the return passage 132*d* in the valve case 132*h*. That is, a flow passage area of the return passage 132*d* becomes maximum. That is, the amount of the fuel to be returned from the inside of the motor housing 20*a* through the return passage 132*d* to the boost line of the second pump section 122 becomes maximum, and therefore the amount of the fuel to be supplied from the inside of the motor housing 20*a* to the engine becomes minimum.

Resulting from such a reduction in the fuel amount to be supplied to the engine, the amount of the return fuel from the engine to the subtank 6 is reduced. Accordingly, the pressure of the return fuel downwardly urging the fuel receptacle 132*a* is reduced, and the fuel receptacle 132*a* is therefore upwardly displaced by the biasing force of the coil spring 132*c*. That is, the valve body 132*b* connected with the fuel receptacle 132*a* is also upwardly displaced to thereby generate vertical slippage of the through-hole 132*e* relative to the return passage 132*d*. As a result, the flow passage area of the return passage 132*d* is reduced, and therefore the fuel amount to be returned from the inside of the motor housing 20*a* to the boost line of the second pump section 122 is reduced. That is, the fuel amount to be supplied from the inside of the motor housing 20*a* to the engine is increased.

In this manner, the fuel amount to be supplied to the engine is controlled by the flow regulating valve 132 according to a fuel consumption in the engine. Accordingly, the same advantage as in the third preferred embodiment can be achieved.

Having thus described the preferred embodiments of the invention, it should be understood that numerous structural modifications and adaptations may be made without departing from the spirit of the invention.

What is claimed is:

1. A fuel supply system comprising:

a main tank for storing a fuel;

a subtank provided in said main tank for storing a part of said fuel;

a first communication line for communicating said main tank to said subtank;

a first pump provided in said first communication line for supplying said fuel from said main tank through said first communication line to said subtank;

first means provided downstream of said first pump in said first communication line for limiting an amount of said fuel to be supplied from said first pump to said subtank and maintaining a level of said fuel to be stored in said subtank;

a second communication line for communicating said subtank to an engine;

a second pump provided in said second communication line for supplying said fuel from said subtank through said second communication line to said engine;

a fuel return pipe for returning an unconsumed part of said fuel from said engine to said subtank; and second means for regulating an amount of said fuel to be supplied from said second pump to said engine according to an amount of said fuel to be returned from said engine through said fuel return pipe to said subtank.

2. A fuel supply system as defined in claim 1, wherein:

said first means comprises a first orifice provided in said first communication line so as to be opened and closed for varying a flow passage area of said first communication line, and a float adapted to float on a surface of said fuel in said subtank and mechanically connected with said first orifice, said float being displaced in a closing direction of said first orifice in concert with lifting of the level of said fuel in said subtank, while being displaced in an opening direction of said first orifice in concert with lowering of the level of said fuel in said subtank; and said second means comprises a second orifice provided in said second communication line so as to be opened and closed for varying a flow passage area of said second communication line, and a pressure receiving member provided near an outlet of said fuel return pipe in said subtank and mechanically connected with said second orifice for receiving a pressure of said fuel returned from said engine to said subtank, said pressure receiving member being displaced in a closing direction of said second orifice in concert with an increase in said fuel to be returned from said engine through said fuel return pipe to said subtank, while being displaced in an opening direction of said second orifice in concert with a decrease in said fuel to be returned from said engine through said fuel return pipe to said subtank.

3. A fuel supply system as defined in claim 1, wherein:

said first means comprises a return line branched from said first communication line on a downstream side of said first pump for returning said fuel discharged from said first pump to said main tank, a first orifice provided in said return line so as to be opened and closed for varying a flow passage area of said return line, and a float adapted to float on a surface of said fuel in said subtank and mechanically connected with said first orifice, said float being displaced in an opening direction of said first orifice in concert with lifting of the level of said fuel in said subtank, while being displaced in a closing direction of said first orifice in concert with lowering of the level of said fuel in said subtank; and said second means comprises a second orifice provided in said second communication line so as to be opened and closed for varying a flow passage area of said second communication line, and a pressure receiving member provided near an outlet of said fuel return pipe in said subtank and mechanically connected with said second orifice for receiving a pressure of said fuel returned from said engine to said subtank, said pressure receiving member being displaced in a closing direction of said second orifice in concert with an increase in said fuel to be returned from said engine through said fuel return pipe to said subtank, while being displaced in an opening direction of said second orifice in concert with a decrease in said fuel to be returned from said engine through said fuel return pipe to said subtank.

4. A fuel supply system as defined in claim 1, wherein:

said first means comprises a first orifice provided in said first communication line so as to be opened and closed for varying a flow passage area of said first communication line, and a float adapted to float on a surface of said fuel in said subtank and mechanically connected with said first orifice, said float being displaced in a closing direction of said first orifice in concert with lifting of the level of said fuel in said subtank, while being displaced in an opening direction of said first orifice in concert with lowering of the level of said fuel in said subtank; and said second means comprises a return line branched from said second communication line at a position downstream of a suction port of said second pump for returning said fuel sucked from said suction port to said subtank, a second orifice provided in said return line so as to be opened and closed for varying a flow passage area of said return line, and a pressure receiving member provided near an outlet of said fuel return pipe in said subtank and mechanically connected with said second orifice for receiving a pressure of said fuel returned from said engine to said subtank, said pressure receiving member being displaced in an opening direction of said second orifice in concert with an increase in said fuel to be returned from said engine through said fuel return pipe to said subtank, while being displaced in a closing direction of said second orifice in concert with a decrease in said fuel to be returned from said engine through said fuel return pipe to said subtank.

5. A fuel supply system as defined in claim 1, wherein:

said first means comprises a return line branched from said first communication line on a downstream side of said first pump for returning said fuel discharged from said first pump to said main tank, a first orifice provided in said return line so as to be opened and closed for varying a flow passage area of said return line, and a float adapted to float on a surface of said fuel in said subtank and mechanically connected with said first orifice, said float being displaced in an opening direction of said first orifice in concert with lifting of the level of said fuel in said subtank, while being displaced in a closing direction of said first orifice in concert with lowering of the level of said fuel in said subtank; and said second means comprises a return line branched from said second communication line at a position downstream of a discharge port of said second pump and returned to a position downstream of a suction port of said second pump and upstream of said discharge port for returning said fuel discharged from said discharge port to said second pump, a second orifice provided in said return line so as to be opened and closed for varying a flow passage area of said return line, and a pressure receiving member provided near an outlet of said fuel return pipe in said subtank and mechanically connected with said second orifice for receiving a pressure of said fuel returned from said engine to said subtank, said pressure receiving member being displaced in an opening direction of said second orifice in concert with an increase in said fuel to be returned from said engine through said fuel return pipe to said subtank, while being displaced in a closing direction of said second orifice in concert with a decrease in said fuel to be returned from said engine through said fuel return pipe to said subtank.

* * * * *